US006475696B2

(12) United States Patent
Majumdar et al.

(10) Patent No.: US 6,475,696 B2
(45) Date of Patent: Nov. 5, 2002

(54) IMAGING ELEMENTS WITH NANOCOMPOSITE CONTAINING SUPPORTS

(75) Inventors: Debasis Majumdar; Narasimharao Dontula, both of Rochester; Dennis J. Massa, Pittsford; Thomas N. Blanton, Rochester; Jose L. Garcia, Webster; Eric E. Arrington, Canandaigua; Thaddeus S. Gula, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/751,192

(22) Filed: Dec. 28, 2000

(65) Prior Publication Data

US 2002/0123015 A1 Sep. 5, 2002

(51) Int. Cl.[7] ..... G03C 1/765; G03C 1/775; G03C 1/79; G03C 1/795; G03C 1/89

(52) U.S. Cl. ..... 430/201; 430/220; 430/523; 430/531; 430/533; 430/536; 430/538; 347/105

(58) Field of Search ..... 430/523, 531, 430/220, 533, 536, 201, 538; 347/105

(56) References Cited

U.S. PATENT DOCUMENTS

| | | | | | |
|---|---|---|---|---|---|
| 4,173,480 | A | * | 11/1979 | Woodward | 430/536 |
| 4,288,524 | A | * | 9/1981 | Bilofsky et al. | 430/220 |
| 4,739,007 | A | | 4/1988 | Okada et al. | 524/789 |
| 4,810,734 | A | | 3/1989 | Kawasumi et al. | 524/714 |
| 4,894,411 | A | | 1/1990 | Okada et al. | 524/710 |
| 5,102,948 | A | | 4/1992 | Deguchi et al. | 524/445 |
| 5,164,440 | A | | 11/1992 | Deguchi et al. | 524/445 |
| 5,164,460 | A | | 11/1992 | Yano et al. | 524/445 |
| 5,244,861 | A | | 9/1993 | Campbell et al. | 503/227 |
| 5,248,720 | A | | 9/1993 | Deguchi et al. | 524/445 |
| 5,854,326 | A | | 12/1998 | Sakaya et al. | 524/445 |
| 5,866,282 | A | | 2/1999 | Bourdelais | 430/536 |
| 5,869,217 | A | * | 2/1999 | Aono | 430/523 |
| 5,869,227 | A | * | 2/1999 | Majumdat et al. | 430/531 |
| 5,874,205 | A | | 2/1999 | Bourdelais et al. | 430/536 |
| 5,888,643 | A | | 3/1999 | Aylward et al. | 430/536 |
| 5,888,683 | A | | 3/1999 | Gula et al. | 430/536 |
| 5,891,611 | A | * | 4/1999 | Majumdat et al. | 430/531 |
| 6,034,164 | A | | 3/2000 | Barbee et al. | 524/445 |
| 6,060,230 | A | | 5/2000 | Christian et al. | 430/530 |

* cited by examiner

*Primary Examiner*—Richard L. Schilling
(74) *Attorney, Agent, or Firm*—Paul A. Leipold; Lynne M. Blank

(57) ABSTRACT

The invention relates to an imaging member comprising an image layer and a support comprising at least one layer comprising an inorganic particle having an aspect ratio of at least 10 to 1, a lateral dimension of between 0.01 $\mu$m and 5 $\mu$m, and a vertical dimension between 0. 5 nm and 10 nm, and polymeric resin.

53 Claims, No Drawings

IMAGING ELEMENTS WITH NANOCOMPOSITE CONTAINING SUPPORTS

FIELD OF THE INVENTION

This invention elates to imaging materials. In a preferred form it relates to an improved base for photographic materials.

BACKGROUND OF THE INVENTION

The need for having thinner and stiffer base for imaging products is well recognized. In addition to providing cost advantage, thinner supports can fulfill many other criteria. For example, in motion picture and related entertainment industry, thinner photographic base allows for longer film footage for the same sized reels. However, a reduction in thickness of the base typically results in a reduction in stiffness, which can have detrimental effects in terms of curl, transport, durability, etc. For display materials, such as photographic papers, it is desirable that the paper be light in weight and flexible for some applications. For instance, when the photographs must be mailed or used as a laminating material, it is desirable that the materials be light in weight. When stored in albums, reduced thickness of the paper will minimize undesirable bulkiness. For some uses such as for a stand-up display and to convey a sense of value, it is desirable that the photographs have a heavy stiff feel. It would be desirable if photographic materials could be easily produced with a variety of stiffness and caliper characteristics so that a variety of consumer desires could be easily met. Present materials have a limited ability to be varied, as the thickness of the base paper and the thickness of the resin-coating on the paper are the only factors that can be varied easily. Further, the cost of forming stiff paper is substantial, as increases in the amount of resin and in the thickness of paper and/or selection of a stiffer resin and paper are expensive. In addition, the increases or decreases in caliper that are required for papers of increased or decreased stiffness lead to difficulties in handling in processing machines for formation of the photosensitive layers and in development after exposure.

It has been proposed in U.S. Pat. No. 5,244,861 to utilize biaxially oriented polypropylene in receiver sheets for thermal dye transfer.

It has been proposed in U.S. Pat Nos. 5,866,282; 5,874,205; 5,888,643; and 5,888,683 to utilize biaxially oriented polyolefin sheets for photographic supports through lamination onto a paper base.

Still there is need in the industry to develop suitable imaging materials which can be conveniently and economically incorporated in imaging supports with appreciable improvement in stiffness, so that thinner caliper can be achieved without sacrificing any desirable characteristics of the support.

Recently, nanocomposite materials have received considerable interest from industrial sectors, such as the automotive industry and the packaging industry for their unique physical properties. These properties include improved heat distortion characteristics, barrier properties, and mechanical properties. The related prior art is illustrated in U.S. Pat. Nos. 4,739,007; 4,810,734; 4,894,411; 5,102,948; 5,164,440; 5,164,460; 5,248,720; 5,854,326; and 6,034,163. However, the use of these nanocomposites in imaging materials for stiffer and thinner support has not been recognized.

PROBLEM TO BE SOLVED BY THE INVENTION

There is a need for providing thinner and stiffer support for imaging materials. In particular, for display materials, such as photographic paper, there is a need for the ability to vary stiffness and caliper of the base in a manner that is independent. There is also a need to accomplish the aforesaid goals with materials of appropriate clarity for application in imaging elements.

SUMMARY OF THE INVENTION

It is an object of the invention to provide imaging materials with improved stiffness for application in photographic base.

It is another object to provide photographic base with equivalent stiffness at reduced thickness.

It is a further object to provide photographic paper with a variety of stiffness and wherein the backside of the paper has back mark retention characteristics.

These and other objects of the invention are accomplished by an imaging member comprising an image layer and a support comprising at least one layer comprising an inorganic particle having an aspect ratio of at least 10 to 1, a lateral dimension of between 0.01 $\mu$m and 5 $\mu$m, and a vertical dimension between 0.5 nm and 10 nm, and polymeric resin.

ADVANTAGEOUS EFFECT OF THE INVENTION

The invention provides imaging materials with improved stiffness for application in photographic base. The invention further provides thinner photographic base without sacrificing stiffness. When incorporated in photographic paper, the invention provides adequate back mark retention characteristics.

DETAILED DESCRIPTION OF THE INVENTION

The invention has numerous advantages over prior methods of adjusting stiffness and thickness in photographic bases. The invention allows the consumer to be provided with papers and film supports that are lightweight but strong. The papers and film supports of the invention further can be provided in a form that is stiff. The invention also allows the formation of stiff papers that are nevertheless light in weight. The lightweight prints of the invention allow storage of prints in albums that are not as bulky. Further, files containing photos such as used by real estate and insurance companies can be thinner. The present invention can provide photographic paper with a bending stiffness between 150 and 225 millinewtons. This bending stiffness can be achieved at a caliper thickness between 0.15 mm and 0.3 mm. Within these ranges a variety of papers may be formed that are strong but provided with any desired caliper or stiffness. The bending stiffness can be measured using a suitable setup such as the Lorentzen & Wettre Stiffness Tester, model 16 D, calculated following mathematical modeling, as described in U.S. Pat. No. 5,902,720. As demonstrated through examples herein below, photographic papers of the invention comprising a nanocomposite material provide higher bending stiffness for the same caliper or same stiffness for lower caliper, when compared with ordinary resin coated photographic, ink jet, and thermal transfer paper that does not comprise the nanocomposite material of the present invention. Moreover, when used on the backside of photographic paper, the invention imparts improved back mark retention characteristics to the photographic element. When used in films, the invention allows longer film footage to be incorporated in the same sized reels.

The invention provides imaging materials comprising nanocomposites, which possess a number of highly desirable properties, such as improved mechanical, thermal, and barrier properties at a relatively low weight % loading (typically<20%) of the inorganic phase. These improvements can be realized in both imaging papers, as well as films. For example, the photographic paper comprising these nanocomposite materials allows faster hardening of photographic paper emulsion, as water vapor is not transmitted from the emulsion through the nanocomposites because of improved barrier properties. Motion picture print films comprising these nanocomposite materials have improved heat distortion temperature undergo less buckling due to thermal heating from the projector light source which otherwise can cause objectionable "out of focus" images on the movie screen. The advantageous low loading level of the inorganic phase in these nanocomposites ensures processability of these materials to be similar to that of the host polymer resin. This allows for utilization of the same manufacturing equipment under similar processing conditions without requiring much capital investment. Low loading of the inorganic phase also provides materials with improved properties without significant increase in cost.

These and other advantages will be apparent from the detailed description below.

Whenever used in the specification, the terms set forth shall have the following meaning:

"Nanocomposite" shall mean a composite material wherein at least one component comprises an inorganic phase, such as a smectite clay, with at least one dimension in the 0.1 to 100 nanometer range.

"Plates" shall mean particles with two comparable dimensions significantly greater than the third dimension.

"Layered material" shall mean an inorganic material such as a smectite clay that is in the form of a plurality of adjacent bound layers.

"Platelets" shall mean individual layers of the layered material.

"Intercalation" shall mean the insertion of one or more foreign molecules or parts of foreign molecules between platelets of the layered material, usually detected by X-ray diffraction technique, as illustrated in U.S. Pat. No. 5,554,670.

"Intercalant" shall mean the aforesaid foreign molecules inserted between platelets of the aforesaid layered material.

"Exfoliation" or "delamination" shall mean separation of individual platelets into a disordered structure without any stacking order.

The phrase "imaging member" includes imaging materials for photographic, ink jet, thermal transfer, and xerographic imaging. Photographic members use silver halide in imaging.

"Top" and "bottom" side of an imaging support shall refer to the side bearing the imaging layer(s) and the opposite side, respectively.

The imaging material of this invention primarily comprises a nanocomposite, which further comprises an inorganic phase and a polymeric resin.

The inorganic phase desirably comprises layered materials in the shape of plates with significantly high aspect ratio. However, other shapes with high aspect ratio will also be advantageous, as per the invention. Phyllosilicates such as those described in U.S. Pat. Nos. 4,739,007, 4,810,734, 4,889,885; 4,894,411; 5,102,948; 5,164,440; 5,164,460; 5,248,720; 5,973,053; and 5,578,672 are preferred for the invention because of their availability and cost. It is known that phyllosilicates, such as smectite clays, e.g., sodium montmorillonite and calcium montmorillonite, can be treated with organic molecules such as ammonium ions to intercalate the organic molecules between adjacent planar silicate layers and/or exfoliate the individual silicate layers. These silicate layers when admixed with a host polymer before, after, or during the polymerization of the host polymer have been found (vide U.S. Pat. Nos. 4,739,007; 4,810,734; and 5,385,776) to improve one or more properties of the polymer, e.g., mechanical strength and/or high temperature characteristics. Phyllosilicates suitable for the present invention include smectite clay, e.g., montmorillonite, particularly sodium montmorillonite, magnesium montmorillonite, and/or calcium montmorillonite, nontronite, beidellite, volkonskoite, hectorite, saponite, sauconite, sobockite, stevensite, svinfordite, vermiculite, magadiute, kenyaite, talc, mica, kaolinite, and mixtures thereof Other useful layered materials include illite, mixed layered illite/smectite minerals, such as ledikite and admixtures of illites with the clay minerals named above. Other useful layered materials, particularly useful with anionic polymers, are the layered hydrotalcites or double hydroxides, such as $Mg_6Al_{3.4}(OH)_{18.8}(CO_3)_{1.7}H_2O$, which have positively charged layers and exchangeable anions in the interlayer spaces. Other layered materials having little or no charge on the layers may be useful provided they can be intercalated with swelling agents, which expand their interlayer spacing. Such layered materials include chlorides such as $FeCl_3$, FeOCl, chalcogenides, such as $TiS_2$, $MoS_2$, and $MoS_3$, cyanides such as $Ni(CN)_2$ and oxides such as $H_2Si_2O_5$, $V_6O_{13}$, $HTiNbO_5$, $Cr_{0.5}V_{0.5}S_2$, $V_2O_5$, Ag doped $V_2O_5$, $W_{0.2}V_{2.8}O7$, $Cr_3O_8$, $MoO_3(OH)_2$, $VOPO_4$—$2H_2O$, $CaPO_4CH_3$—$H_2O$, $MnHAsO_4$—$H_2O$, $Ag_6Mo_{10}O_{33}$, and the like. Preferred layered materials are swellable so that other agents, usually organic ions or molecules, can intercalate and/or exfoliate the layered material resulting in a desirable dispersion of the inorganic phase. These swellable layered materials include phyllosilicates of the 2:1 type having a negative charge on the layers and a commensurate number of exchangeable cations in the interlayer space to maintain overall charge neutrality. Typical phyllosilicates with cation exchange capacity of 50 to 300 milliequivalents per 100 grams are preferred. Most preferred layered materials for the present invention include smectite clay such as montmorillonite, nontronite, beidellite, volkonskoite, hectorite, saponite, sauconite, sobockite, stevensite, svinfordite, halloysite, magadiite, kenyaite and vermiculite.

The aforementioned smectite clay can be natural or synthetic. This distinction can influence the particle size and/or the level of associated impurities. Typically, synthetic clays are smaller in lateral dimension and, therefore, possess smaller aspect ratio. However, synthetic clays are purer and are of narrower size distribution, compared to natural clays and may not require any further purification or separation. For this invention, the clay particles suitably have a lateral dimension of between 0.01 $\mu$m and 5 $\mu$m, and preferably between 0.05 $\mu$m and 2 $\mu$m, and more preferably between 0.1 $\mu$m and 1 $\mu$m because if the particle dimension is too small, it does not significantly improve physical properties and if too large, the optical properties are deteriorated. The thickness or the vertical dimension of the clay particles can vary between 0.5 nm and 10 nm, and preferably between 1 nm and 5 nm. The aspect ratio, which is the ratio of the largest and smallest dimension of the clay particles, should be >10:1 and preferably >100:1 and more preferably >1000:1 for this invention because if the material is too thick, it is not optically acceptable. The aforementioned limits regarding the size and shape of the particles are to ensure adequate improvements in some properties of the nanocomposites without deleteriously affecting others. For example, a large lateral dimension may result in an increase in the aspect ratio, a desirable criterion for improvement in mechanical and barrier properties. However, very large particles can cause optical defects, such as haze, and can be abrasive to processing, conveyance and finishing equipment, as well as the imaging layers.

Swellable layered materials, such as the preferred smectite clay materials, generally require treatment by one or more intercalants to provide the required interlayer swelling and/or polymer compatibility. The resulting interlayer spacing is critical to the performance of the intercalated layered material in the practice of this invention. As used herein, the "interlayer spacing" refers to the distance between the faces of the layers as they are assembled in the intercalated material before any delamination (or exfoliation) takes place. The preferred clay materials generally include interlayer or exchangeable cations such as $Na^+$, $Ca^{+2}$, $K^+$, $Mg^{+2}$, and the like. In this state, these materials do not delaminate in host polymer melts regardless of mixing because their interlayer spacings are usually very small (typically equal to or less than about 0.4 nm), and consequently the interlayer cohesive energy is relatively strong. Moreover, the metal cations do not aid compatibility between layers and the polymer melt. In the preferred embodiments, these layered materials are intercalated by swelling agents of sufficient size to increase interlayer distances to the desired extent. In general, the interlayer distance should be at least about 0.5 nm as determined by X-ray diffraction, in order to facilitate delamination of the layered material at the nanoscale. In the preferred embodiments of the invention, the swelling agent is a neutral organic molecule or an ionic species which is capable of exchanging with the interlayer cations such as $Li^+$, $Na^+$, $Ca^{+2}$, $K^+$, $Mg^{+2}$ and is of sufficient size to provide the required interlayer spacing. Such ionic species include $NH_4^+$, $Al^{+3}$, $Cu^{2+}$, $Fe^{+3}$, $NH_3R^1$+, $NH_2$ $R^1$ $R^{2+}$, $NHR^1$ $R^2$ $R^{3+}$, $NR^1$ $R^2$ $R^3$ $R^{4+}$, where the $R^1$, $R^2$, $R^3$, and $R^4$ are the same or different and are organic substituents, and the like.

In order to further facilitate delamination of layered materials into platelet particles and prevent reaggregation of the particles, these layers are preferably polymer-compatible. In cases where the polymer is not compatible with the layers, the swellable layered material is intercalated by compatibilizing agents which consist of a portion which bonds to the surface of the layers and another portion which bonds or interacts favorably with the polymer. In some instances, intercalants are used which are swelling and compatibilizing agents, which provide both the swelling function and the compatibilization function. Such agents preferably include a moiety or moieties which interact with the surface of the layers displacing, totally or in part, the original metal ions and which bonds to the surface of the layers; and includes a moiety or moieties whose cohesive energies are sufficiently similar to that of the polymer that the surface of the platelets is made more compatible with the polymer, thereby enhancing the homogeneity of the dispersion in the polymeric matrix. As used herein "compatible" refers to the extent to which the host polymer and the surface coating on the platelet particles (the compatibilizing agent) have a favorable interaction which promotes the intermingling of the host polymer and the surface layer in the interphase region. Compatibility derives from one or more of the following criteria: similar cohesive energy densities for the polymer and the functionalized platelets, similar or complimentary capacities for dispersive, polar, or hydrogen bonding interactions, or other specific interactions, such as acid/base or Lewis-acid/Lewis-base interactions. Compatibilization will lead to an improved dispersion of the platelet particles in the host polymer and/or an improved percentage of exfoliated or delaminated platelets.

The nature of the swelling and compatibilizing agents will vary widely depending on the particular polymer and the particular layered material. These agents can be organic compounds, which are neutral or ionic. Useful neutral organic molecules include polar molecules such as amides, esters, lactams, nitriles, ureas, carbonates, phosphates, phosphonates, sulfates, sulfonates, nitro compounds, and the like. Preferred neutrals organics can be monomeric, oligomeric, or polymeric. Neutral organic molecules can cause intercalation in the layers through hydrogen bonding, without completely replacing the original metal cations. Useful ionic compounds are cationic surfactants including onium species such as ammonium (primary, secondary, tertiary, and quaternary), phosphonium, or sulfonium derivatives of aliphatic, aromatic or arylaliphatic amines, phosphines, and sulfides. Typically onium ions can cause intercalation in the layers through ion exchange with the metal cations of the preferred smectite clay. Another class of useful swelling and compatibilizing agents includes those which are covalently bonded to the layers of the preferred smectite clay. Illustrative of such groups useful in the practice of this invention are organosilane, organozirconate, and organotitanate coupling agents. In some instances, it is convenient to use a compatibilizing agent that is different from the swelling agent. For example, alkylammonium cations may be used to replace the metal cations of a smectite mineral and be partially replaced, in turn, by a silane coupling agent. In this case, the alkylanmmonium cation functions as a general purpose swelling agent, while the silane can function as a compatibilizing agent that is highly specific to a selected polymer system. In the preferred embodiments of the invention, the swelling agent and/or the compatibilizing agent will include a moiety which bonds to the surface of the layered material and will not be reactive with the polymer. Preferably, the agent will also include a moiety, which may not bond with the layered material, but is compatible with the polymer. Agents containing onium groups and silane agents, particularly those with lipophilic portions, are most preferred for the treatment of the preferred smectite clay in accordance with the present invention.

Examples of various types of swelling agents and compatibilizing agents useful for treating the preferred smectite clay of this invention are included in, but not limited to, the disclosures of U.S. Pat. Nos. 4,739,007; 4,810,734, 4,889,885; 4,894,411; 5,102,948; 5,164,440; 5,164,460; 5,248,720; 5,973,053; 5,578,672; 5,698,624; 5,760,121; 5,804,613; 5,830,528; 5,837,763; 5,844,032; 5,877,248; 5,880,197; 6,057,396; 5,384,196; 5,385,776; 5,514,734; 5,747,560; 5,780,376; 6,036,765; 6,034,163; 6,084,019; and 5,952,093.

Treatment of the preferred smectite clay by the appropriate swelling and/or compatibilizing agents can be accomplished by any method known in the art, such as those discussed in U.S. Pat. Nos. 4,889,885; 5,385,776; 5,747,560; and 6,034,163. The amount of swelling and/or compatibilizing agent can also vary substantially provided the amount is effective to swell, and preferably to compatibilize the layers to obtain the desired substantially uniform dispersion. This amount can vary from 10 millimole/100 g of material to 1000 millimole/100 g of material. Some of the clay vendors, such as Nanocor and Southern Clay Products, market organoclays, which are functionalized clays with predetermined amounts of specific swelling and/or compatibilizing agents developed for specific host polymers. These ready-made products may provide easy incorporation of the inorganic phase in the host polymer for the nanocomposite of the present invention.

The host polymeric resin of the nanocomposite of the present invention can be any polymer but preferred to be thermoplastic polymers, interpolymers and/or mixtures thereof, and thermoplastic elastomers. The host or matrix polymer is the sheet forming polymer in which the inorganic particles are dispersed prior to being cast or formed into a sheet for use in an imaging member.

Illustrative of useful matrix thermoplastic resins are polylactones such as poly(pivalolactone), poly(caprolactone), and the like, polyurethanes derived from reaction of diisocyanates such as 1,5-naphthalene diisocyanate, p-phenylene diisocyanate, m-phenylene diisocyanate, 2,4-toluene diisocyanate, 4,4'-diphenylmethane diisocyanate, 3,3'-dimethyl-4,4'diphenyl-methane diisocyanate, 3,3-'dimethyl-4,4'-biphenyl diisocyanate, 4,4'-diphenylisopropylidene diisocyanate, 3,3'-dimethyl-4,4'-diphenyl diisocyanate, 3,3'-dimethyl-4,4'-diphenylmethane diisocyanate, 3,3'-dimethoxy-4,4'-biphenyl diisocyanate, dianisidine diisocyanate, tolidine diisocyanate, hexamethylene diisocyanate, 4,4'-diisocyanatodiphenylmethane and the like; and linear long-chain diols such as poly(tetramethylene adipate), poly(ethylene adipate), poly(1,4-butylene adipate), poly(ethylene succinate), poly(2,3-butylenesuccinate), polyether diols and the like; polycarbonates such as poly (methane bis(4-phenyl) carbonate), poly(1,1-ether bis(4-phenyl) carbonate), poly(diphenylmethane bis(4-phenyl) carbonate), poly(1,1-cyclohexane bis(4-phenyl)carbonate), poly(2,2-bis-(4-hydroxyphenyl) propane) carbonate, and the like; polysulfones, polyether ether ketones; polyamides such as poly (4-amino butyric acid), poly(hexamethylene adipamide), poly(6-aminohexanoic acid), poly(m-xylylene adipamide), poly(p-xylyene sebacamide), poly(2,2,2-trimethyl hexamethylene terephthalamide), poly (metaphenylene isophthalamide) (Nomex), poly(p-phenylene terephthalamide)(Kevlar), and the like; polyesters such as poly(ethylene azelate), poly(ethylene-1,5-naphthalate), poly(ethylene-2,6-naphthalate), poly(1,4-cyclohexane dimethylene terephthalate), poly(ethylene oxybenzoate) (A-Tell), poly(para-hydroxy benzoate) (Ekonol),poly(1,4-cyclohexylidene dimethylene terephthalate) (Kodel) (cis), poly(1,4-cyclohexylidene dimethylene terephthalate) (Kodel) (trans), polyethylene terephthlate, polybutylene terephthalate and the like; poly (arylene oxides) such as poly(2,6-dimethyl-1,4-phenylene oxide), poly(2,6-diphenyl-1,4-phenylene oxide) and the like poly(arylene sulfides) such as poly(phenylene sulfide) and the like; polyetherimides; vinyl polymers and their copolymers such as polyvinyl acetate, polyvinyl alcohol, polyvinyl chloride, polyvinyl butyral, polyvinylidene chloride, ethylene-vinyl acetate copolymers, and the like; polyacrylics, polyacrylate and their copolymers such as polyethyl acrylate, poly(n-butyl acrylate), polymethylmethacrylate, polyethyl methacrylate, poly(n-butyl methacrylate), poly(n-propyl methacrylate), polyacrylamide, polyacrylonitrile, polyacrylic acid, ethylene-acrylic acid copolymers, ethylene-vinyl alcohol copolymers acrylonitrile copolymers, methyl methacrylate-styrene copolymers, ethylene-ethyl acrylate copolymers, methacrylated budadiene-styrene copolymers and the like; polyolefins such as (linear) low and high density poly (ethylene), poly(propylene), chlorinated low density poly (ethylene), poly(4-methyl-1-pentene), poly(ethylene), poly (styrene), and the like; ionomers; poly(epichlorohydrins); poly(urethane) such as the polymerization product of diols such as glycerin, trimethylol-propane, 1,2,6-hexanetriol, sorbitol, pentaerythritol, polyether polyols, polyester polyols and the like with a polyisocyanate such as 2,4-tolylene diisocyanate, 2,6-tolylene diisocyante, 4,4'-diphenylmethane diisocyanate, 1,6-hexamethylene diisocyanate, 4,4'-dicycohexylmethane diisocyanate and the like; and polysulfones such as the reaction product of the sodium salt of 2,2-bis(4-hydroxyphenyl) propane and 4,4'-dichlorodiphenyl sulfone; furan resins such as poly(furan); cellulose ester plastics such as cellulose acetate, cellulose acetate butyrate, cellulose propionate and the like; silicones such as poly(dimethyl siloxane), poly(dimethyl siloxane), poly(dimethyl siloxane co-phenylmethyl siloxane), and the like, protein plastics, polyethers; polyimides; polyvinylidene halides; polycarbonates; polyphenylenesulfides; polytetrafluoroethylene; polyacetals; polysulfonates; polyester ionomers; polyolefin ionomers; Copolymers and/or mixtures of these aforementioned polymers can also be used.

Thermoplastic elastomers useful in the practice of this invention may also vary widely. Illustrative of such elastomers are brominated butyl rubber, chlorinated butyl rubber, polyurethane elastomers, fluoroelastomers, polyester elastomers, butadiene/acrylonitrile elastomers, silicone elastomers, poly(butadiene), poly(isobutylene), ethylene-propylene copolymers, ethylene-propylene-diene terpolymers, sulfonated ethylene-propylene-diene terpolymers, poly(chloroprene), poly(2,3-dimethylbutadiene), poly(butadiene-pentadiene), chlorosulphonated poly(ethylenes), poly(sulfide) elastomers, block copolymers, made up of segments of glassy or crystalline blocks such as poly(styrene), poly(vinyl-toluene), poly(t-butyl styrene), polyester and the like, and the elastomeric blocks such as poly(butadiene), poly(isoprene), ethylene-propylene copolymers, ethylene-butylene copolymers, polyether ester and the like as, for example, the copolymers in poly(styrene)-poly(butadiene)-poly(styrene) block copolymer manufactured by Shell Chemical Company under the trade name of Kraton.RTM. Copolymers and/or mixtures of these aforementioned polymers can also be used.

Preferred thermoplastic polymers for the present invention are thermoplastic polymers such as polyamides, polyesters, and polymers of alpha-beta unsaturated monomers and copolymers.

Polyamides, which may be used in the present invention, are synthetic linear polycarbonamides characterized by the presence of recurring carbonamide groups as an integral part of the polymer chain, which are separated from one another by at least two carbon atoms. Polyamides of this type include polymers, generally known in the art as nylons, obtained from diamines and dibasic acids having the recurring unit represented by the general formula:

$$—NHCOR^5\ COHNR^6—$$

in which $R^5$ is an alkylene group of at least 2 carbon atoms, preferably from about 2 to about 11 or arylene having at least about 6 carbon atoms, preferably about 6 to about 17 carbon atoms; and $R^6$ is selected from $R^5$ and aryl groups. Also, included are copolyamides and terpolyamides obtained by known methods, for example, by condensation of hexamethylene diamine and a mixture of dibasic acids consisting of terephthalic acid and adipic acid. Polyamides of the above description are well known in the art and include, for example, the copolyarnide of 30% hexamethylene diammonium isophthalate and 70% hexamethylene diammonium adipate, poly(hexamethylene adipamide) (nylon 6,6), poly (hexamethylene sebacamide) (nylon 6,10), poly (hexamethylene isophthalamide), poly(hexamethylene terephthalamide), poly(heptamethylene pimelamide) (nylon 7,7), poly(octamethylene suberamide) (nylon 8,8), poly (nonamethylene azelamide) (nylon 9,9) poly (decamethylene azelamide) (nylon 10,9), poly (decamethylene sebacamide) (nylon 10,10), poly(bis(4-amino cyclohexyl)methane-1,10-decane-carboxamide)), poly(m-xylylene adipamide), poly(p-xylene sebacamide), poly(2,2,2-trimethyl hexamethylene terephthalamide), poly (piperazine sebacamide), poly(p-phenylene terephthalamide), poly(metaphenylene isophthalamide), and the like.

Other useful polyamides are those formed by polymerization of amino acids and derivatives thereof as, for example, lactams. Illustrative of these useful polyamides are poly(4-aminobutyric acid) (nylon 4), poly(6-aminohexanoic acid) (nylon 6), poly(7-aminoheptanoic acid) (nylon 7), poly(8-aminooctanoic acid) (nylon 8), poly(9-aminononanoic acid) (nylon 9), poly(10-amino-decanoic acid) (nylon 10), poly(11-aminoundecanoic acid) (nylon 11), poly(12-aminododecanoic acid) (nylon 12), and the like.

Preferred polyamides for use in the practice of this invention include poly(caprolactam), poly(12-aminododecanoic acid), poly(hexamethylene adipamide), poly(m-xylylene adipamide), and poly(6-aminohexanoic acid) and copolymers and/or mixtures thereof.

Other host polymers, which may be employed in the process of this invention, are linear polyesters. The type of polyester is not critical, and the particular polyesters chosen for use in any particular situation will depend essentially on the physical properties and features, i.e., tensile strength, modulus and the like, desired in the final form. Thus, a multiplicity of linear thermoplastic polyesters having wide variations in physical properties is suitable for use in the process of this invention.

The particular polyester chosen for use can be a homopolyester or a co-polyester, or mixtures thereof as desired. Polyesters are normally prepared by the condensation of an organic dicarboxylic acid and an organic diol and, therefore, illustrative examples of useful polyesters will be described herein below in terms of these diol and dicarboxylic acid precursors.

Polyesters which are suitable for use in this invention are those which are derived from the condensation of aromatic, cycloaliphatic, and aliphatic diols with aliphatic, aromatic and cycloaliphatic dicarboxylic acids and may be cycloaliphatic, aliphatic or aromatic polyesters. Exemplary of useful cycloaliphatic, aliphatic and aromatic polyesters which can be utilized in the practice of their invention are poly(ethylene terephthalate), poly (cyclohexlenedimethylene), terephthalate) poly(ethylene dodecate), poly(butylene terephthalate), poly(ethylene naphthalate), poly(ethylene(2,7-naphthalate)), poly (methaphenylene isophthalate), poly(glycolic acid), poly (ethylene succinate), poly(ethylene adipate), poly(ethylene sebacate), poly(decamethylene azelate), poly(ethylene sebacate), poly(decamethylene adipate), poly (decamethylene sebacate), poly(dimethylpropiolactone), poly(para-hydroxybenzoate) (Ekonol), poly(ethylene oxybenzoate) (A-tell), poly(ethylene isophthalate), poly (tetramethylene terephthalate, poly(hexamethylene terephthalate), poly(decamethylene terephthalate), poly(1,4-cyclohexane dimethylene terephthalate) (trans), poly (ethylene 1,5-naphthalate), poly(ethylene 2,6-naphthalate), poly(1,4-cyclohexylene dimethylene terephthalate), (Kodel) (cis), and poly(1,4-cyclohexylene dimethylene terephthalate (Kodel) (trans).

Polyester compounds prepared from the condensation of a diol and an aromatic dicarboxylic acid is preferred for use in this invention. Illustrative of such useful aromatic carboxylic acids are terephthalic acid, isophthalic acid and an α-phthalic acid, 1,3-napthalenedicarboxylic acid, 1,4 napthalenedicarboxylic acid, 2,6-napthalenedicarboxylic acid, 2,7-napthalenedicarboxylic acid, 4,4'-diphenyldicarboxylic acid, 4,4'-diphenysulfphonedicarboxylic acid, 1,1,3-trimethyl-5-carboxy-3-(p-carboxyphenyl)-idane, diphenyl ether 4,4'-dicarboxylic acid, bis-p(carboxy-phenyl) methane, and the like. Of the aforementioned aromatic dicarboxylic acids, those based on a benzene ring (such as terephthalic acid, isophthalic acid, orthophthalic acid) are preferred for use in the practice of this invention. Amongst these preferred acid precursors, terephthalic acid is particularly preferred acid precursor.

Preferred polyesters for use in the practice of this invention include poly(ethylene terephthalate), poly(butylene terephthalate), poly(1,4-cyclohexylene dimethylene terephthalate) and poly(ethylene naphthalate) and copolymers and/or mixtures thereof Among these polyesters of choice, poly(ethylene terephthalate) is most preferred.

Another set of useful matrix or host thermoplastic polymers are formed by polymerization of alpha-beta-unsaturated monomers of the formula:

$$R^7R^8C{=}CH_2$$

wherein: $R^7$ and $R^8$ are the same or different and are cyano, phenyl, carboxy, alkylester, halo, alkyl, alkyl substituted with one or more chloro or fluoro, or hydrogen. Illustrative of such preferred polymers include polymers of ethylene, propylene, hexene, butene, octene, vinylalcohol, acrylonitrile, vinylidene halide, salts of acrylic acid, salts of methacrylic acid, tetrafluoroethylene, chlorotrifluoroethylene, vinyl chloride, styrene,and the like. Copolymers and/or mixtures of these aforementioned polymers can also be used in the present invention.

Preferred thermoplastic polymers formed by polymerization of alpha-beta-unsaturated monomers for use in the practice of this invention are poly(propylene), poly (ethylene), poly(styrene) and copolymers and/or mixtures thereof, with poly(propylene) polymers and copolymers being most preferred for their low cost and good mechanical and surface properties.

The amount of the inorganic phase in the nanocomposite of this invention should be chosen according to specific application. If the amount of the inorganic phase is chosen to be too low, the desired improvement in properties may not be achieved. Conversely, if the amount of the inorganic phase is chosen to be too high, the material may become brittle or intractable for processing under typical processing conditions. The amount of the inorganic phase in the nanocomposite of this invention should be preferably chosen between 1 to 20 parts by weight, and more preferably between 2 and 15 parts by weight, and most preferably between 5 and 10 parts by weight, in order to optimize properties and processability. Besides the preferred smectite clay, the swelling and/or compatibilizing agent and the host polymer resin, the nanocomposite of the present invention may include other optional components. Such optional components include nucleating agents, fillers, plasticizers, impact modifiers, chain extenders, colorants, lubricants, antistatic agents, pigments such as titanium oxide, zinc oxide, talc, calcium carbonate, etc., dispersants such as fatty amides, (e.g., stearamide), metallic salts of fatty acids, e.g., zinc stearate, magnesium stearate, etc., dyes such as ultramarine blue, cobalt violet, etc., antioxidants, fluorescent whiteners, ultraviolet absorbers, fire retardants, roughening agents, cross-linking agents, voiding agents, and the like. These optional components and appropriate amounts are well known in the art and can be chosen according to need.

The nanocomposite of the invention can be formed by any suitable means known in the art of making nanocomposites. For example, the inorganic phase, preferably the smectite clay with necessary functionalization, such as with swelling and/or compatibilizing agents, can be dispersed in a suitable monomer or oligomer of the host resin, which is subsequently polymerized, following methods similar to those disclosed in U.S. Pat. Nos. 4,739,007 and 4,810,734. Alternatively, the inorganic phase, preferably the smectite clay with necessary functionalization, can be melt blended with the host polymer, oligomer or mixtures thereof at temperatures preferably comparable to their melting point or above, and sheared, following methods similar to those disclosed in U.S. Pat. Nos. 5,385,776; 5,514,734; and 5,747,560. The invention is described with the imaging support preferably being used for photographic imaging elements. However, the support of the invention could be used for any imaging element, such as photographic, electrophotographic, electrostatographic, photothermographic, migration, electrothermographic, dielectric recording, thermal dye transfer, ink jet, and others.

The imaging material of this invention can be formed into imaging supports by any suitable method known in the art such as, solvent casting, extrusion, co-extrusion, blow molding, injection molding, lamination, etc., with or without orientation by stretching. In the preferred case where the nanocomposite containing material is oriented, it is desired that stretching is accomplished in at least one direction, and preferably in both directions or biaxially, either simultaneously or consecutively, following any method known in the art for biaxial orientation of polymeric materials.

In one embodiment, the imaging support of the invention may be formed by extruding the nanocomposite, followed by orientation, as in typical polyester based photographic film base formation. Alternatively, the nanocomposite can be extrusion coated onto another support, as in typical resin coating operation for photographic paper. Yet in another embodiment, the nanocomposite can be extruded, preferably oriented, into a preformed sheet and subsequently laminated to another support, as in the formation of a typical packaging product.

The imaging support of this invention can comprise the nanocomposite material in any suitable amount, in a single layer, or multiple layers. Typical imaging supports include cellulose nitrate, cellulose acetate, poly(vinyl acetate), polystyrene, poly(ethylene terephthalate), poly(ethylene naphthalate), polycarbonate, polyamide, polyimide, glass, natural and synthetic paper, resin-coated paper, voided polymer, fabric, etc., and the nanocomposite of this invention can be incorporated in any suitable support. The nanocomposite material can be placed anywhere in the imaging support, e.g., on the topside, or the bottom side, or both sides, and/or in between the two sides of the support.

In a preferred embodiment, the imaging material of this invention is incorporated in imaging supports used for image display such as papers, particularly resin-coated papers, voided polymers, and combinations thereof. In a preferred embodiment, at least one layer comprising the nanocomposite of the present invention is incorporated in a paper support by extrusion, co-extrusion, lamination, etc. In another preferred embodiment, at least one layer comprising the nanocomposite of the present invention is incorporated in an imaging support comprising a voided polymer by extrusion, co-extrusion, lamination, etc.

The imaging supports of the invention can comprise any number of auxiliary layers, which may or may not comprise a nanocomposite. Such auxiliary layers may include antistatic layers, back mark retention layers, tie layers or adhesion promoting layers, abrasion resistant layers, conveyance layers, barrier layers, splice providing layers, UV absorption layers, antihalation layers, optical effect providing layers, waterproofing layers, and the like.

In any application, the layer comprising the nanocomposite can be voided or non-voided. Voiding of layers can be accomplished by incorporating additional void-initiating materials in the layer, followed by appropriate orientation. The void-initiating materials can be polymeric or inorganic particles. Alternatively, the inorganic particles, preferably the layered phyllosilicates, inherent to the nanocomposite, can be utilized to initiate voids during orientation of the layer. The requirement of the void initiating material, processes for forming voided layers, and their incorporation in imaging elements are well known in the art, e.g., U.S. Pat. Nos. 5,866,282; 5,888,643; and 5,902,720.

Particularly suitable display type imaging supports for the practice of this invention are those described in U.S. Pat. Nos. 3,411,908; 3,501,298; 4,042,398; 4,188,220; 4,699,874; 4,794,071; 4,801,509; 5,244,861; 5,326,624; 5,395,689; 5,466,519; 5,780,213; 5,853,965; 5,866,282; 5,874,205; 5,888,643; 5,888,681; 5,888,683; 5,902,720; 5,935,690; 5,955,239; 5,994,045; 6,017,685; 6,017,686; 6,020,116; 6,022,677; 6,030,742; 6,030,756; 6,030,759; 6,040,036; 6,043,009; 6,045,965; 6,063,552; 6,071,654; 6,071,680; 6,074,788; and 6,074,793.

The following examples illustrate the practice of this invention. They are not intended to be exhaustive of all possible variations of the invention. Parts and percentages are by weight unless otherwise indicated.

EXAMPLES

The nanocomposite materials of the following examples are prepared by utilizing a commercial smectite clay-polypropylene master batch C.31 PS, supplied by Nanocor. The master batch C.31 PS comprise a smectite clay, which has been functionalized with appropriate swelling and compatibilizing agents, and polypropylene. Such a master batch has been further diluted with additional amounts of polypropylene in a co-rotating twin-screw compounder to form the nanocomposite materials, NC 1–4, of the present invention. The nominal smectite clay content of the aforementioned nanocomposite materials, NC 1–4, is provided in Table 1 herein below. Included in Table 1 is a comparative material, NC 0, which is essentially a polypropylene homopolymer without any smectite clay.

TABLE 1

| Materials | Smectite clay content, weight % |
|---|---|
| NC 0 | 0 |
| NC 1 | 2.5 |

TABLE 1-continued

| Materials | Smectite clay content, weight % |
|---|---|
| NC 2 | 5.0 |
| NC 3 | 7.5 |
| NC 4 | 10 |

The aforementioned materials NC 0–4 are formed into sheets either by extrusion without any subsequent orientation, or by extrusion followed by biaxial orientation by stretching by 5× in the machine direction and 5× in the cross direction, and the Young's modulus (YM) of all of these aforementioned sheets measured. Details about these samples and the corresponding YM values are compiled in Table 2.

TABLE 2

| Sample | Material | Smectite clay content, weight % | Formation method | Young's modulus (YM), MPa |
|---|---|---|---|---|
| Ex. 0a | NC 0 | 0 | Extruded & not-oriented | 1213 |
| Ex. 1a | NC 1 | 2.5 | Extruded & not-oriented | 1306 |
| Ex. 2a | NC 2 | 5.0 | Extruded & not-oriented | 1446 |
| Ex. 3a | NC 3 | 7.5 | Extruded & not-oriented | 1719 |
| Ex. 4a | NC 4 | 10.0 | Extruded & not-oriented | 1706 |
| Ex. 0b | NC 0 | 0 | Extruded & biaxially oriented | 2386 |
| Ex. 1b | NC 1 | 2.5 | Extruded & biaxially oriented | 3179 |
| Ex. 2b | NC 2 | 5.0 | Extruded & biaxially oriented | 3165 |
| Ex. 3b | NC 3 | 7.5 | Extruded & biaxially oriented | 3282 |
| Ex. 4b | NC 4 | 10.0 | Extruded & biaxially oriented | 3075 |

It is clear from Table 2 that the incorporation of 2.5–10% by weight of smectite clay in the nanocomposites of the present invention results in a substantial increase in the Young's modulus of extruded sheets, with or without biaxial orientation. When sample Ex. 3a is compared with sample Ex. 0a, and sample Ex. 3b is compared with sample Ex. 0b, it is clear that such an increase in Young's modulus can be as high as ~40%, demonstrating the desirability of the nanocomposites of the present invention.

When incorporated as a top layer and a bottom layer over photographic paper, the nanocomposite material of the present invention can provide improved stiffness and/or reduced caliper, when compared with ordinary resin coated paper wherein the resin coating does not comprise the nanocomposite material of the present invention. Additionally, the nanocomposite containing layer, if used as an external surface for photographic paper, provides acceptably good back mark retention (BMR) ratings, as per a test described in U.S. Pat. No. 6,077,656 wherein BMR ratings of 1–3 are considered acceptably good and ratings of 4–5 are considered unacceptable. These facts are illustrated through the following composite supports.

Composite Support 1a (Comparative)

This support is a composite photographic paper support wherein the top and the bottom sheets are made of Ex. 1a of Table 2, consisting of material NC 0 with no smectite clay, cast on a sheet of cellulosic paper, as schematically shown herein below. The thickness of the top and the bottom sheets is the same and is equal to 0.0254 mm, and the corresponding YM is 1213 MPa. The thickness of the middle sheet of cellulosic paper is 0.1626 mm, and the corresponding YM is 5688 MPa.

Top sheet made of Ex 0a, (0% smectite content);
YM=1213 MPa; Thickness=0.0254 mm
Sheet of cellulosic paper,
YM=5688 MPa; Thickness=0.1626 mm
Bottom sheet made of Ex 0a, (0% smectite content);
YM=1213 MPa; Thickness=0.0254 mm The bending stiffness of Composite support 1a (comparative) is 191 millinewtons, the overall caliper is 0.2134 mm, and the BMR rating for the backside is 5 and, therefore, unacceptable.

Composite Support 1b (Invention)

This support is a composite photographic paper support wherein the top and the bottom sheets are made of Ex. 3a of Table 2, consisting of material NC 3 with 7.5 weight % smectite clay, cast on the same sheet of cellulosic paper as in Composite support 1a, as schematically shown herein below. The thickness of the top and the bottom sheets is the same as that of Composite support 1a and is equal to 0.0254 mm. The YM of the top and the bottom sheets is 1719 MPa. The thickness of the middle sheet of cellulosic paper is the same as that of Composite support 1a and is equal to 0.1626 mm. The YM of the middle sheet of cellulosic paper is the same as that of Composite support 1a and is 5688 MPa.

Top sheet made of Ex 3a, (7.5% smectite content);
YM=1719 MPa; Thickness=0.0254 mm
Sheet of cellulosic paper;
YM=5688 MPa; Thickness=0.1626 mm
Bottom sheet made of Ex 3a, (7.5% smectite content);
YM=1719 MPa; Thickness=0.0254 mm The bending stiffness of Composite support 1b (invention) is 208 millinewtons, the overall caliper is 0.2134 mm, and the BMR rating for the backside is 2 and, therefore, acceptably good.

Comparison of Composite supports 1a (comparative) and 1b (invention) clearly reveals that for the same caliper with the same cellulosic paper core, composite support comprising the nanocomposite material made in accordance with the present invention provides higher stiffness and better back mark retention.

Composite Support 1c (Invention)

This support is a composite photographic paper support wherein the top and the bottom sheets are made of Ex. 3a of Table 2, consisting of material NC 3 with 7.5 weight % smectite clay, cast on the same sheet of cellulosic paper as in Composite support 1a, as schematically shown herein below. The thickness of the top and the bottom sheets is the same and is equal 0.0190 mm. The YM of the top and the bottom sheets is 1719 MPa. The thickness of the middle sheet of cellulosic paper is the same as that of Composite support 1a and is equal to 0.1626 mm. The YM of the middle sheet of cellulosic paper is the same as that of Composite support 1a and is equal to 5688 MPa.

Top sheet made of Ex 3a, (7.5% smectite content);
YM=1719 MPa; Thickness=0.0190 mm
Sheet of cellulosic paper,
YM=5688 MPa; Thickness=0.1626 mm
Bottom sheet made of Ex 3a, (7.5% smectite content).
YM=1719 MPa; Thickness=0.0190 mm The bending stiffness of Composite support c (invention) is 191 millinewtons, the overall caliper is 0.2006 mm, and the BMR rating for the backside is 2 and, therefore, acceptably good.

Comparison of Composite supports 1a (comparative) and 1c (invention) clearly reveals that for the same cellulosic paper core, the composite support comprising the nanocomposite material made in accordance with the resent invention can provide the same stiffness at overall lower caliper and better back mark retention. In fact, Composite support 1c (invention) provides the same stiffness at 25% reduced thickness of the top and bottom resin sheets, when compared with Composite support 1a (comparative), providing substantial savings in costly resin materials.

Composite Support 2a (Comparative)

This support is a composite photographic paper support wherein the top and the bottom sheets, made of Ex. 0b of Table 2, consisting of material NC 0 with no smectite clay, are laminated onto a sheet of cellulosic paper, utilizing a top and a bottom tie layer made of clear polyethylene, as schematically shown herein below. The thickness of the top and the bottom sheets is the same and is equal to 0.0191 mm, and the corresponding YM is 2386 MPa. The thickness of the middle sheet of cellulosic paper is 0.1524 mm, and the corresponding YM is 5688 MPa. The thickness of the top and the bottom tie-layers is the same and is equal to 0.0127 mm, and the corresponding YM is 138 MPa.

Top sheet made of Ex 0b, (0% smectite content);
YM=2386 MPa; Thickness=0.0191 mm
Top tie-layer made of polyethylene
YM=138 MPa; Thickness=0.0127 mm
Sheet of cellulosic paper,
YM=5688 MPa; Thickness=0.1524 mm
Bottom tie-layer made of polyethylene
YM=138 MPa; Thickness=0.0127 mm
Bottom sheet made of Ex 0b, (0% smectite content),
YM=2386 MPa; Thickness=0.0191 mm The bending stiffness of Composite support 2a (comparative) is 191 millinewtons, the overall caliper is 0.2160 mm, and the BMR rating for the backside is 5 and, therefore, unacceptable.

Composite Support 2b (Invention)

This support is a composite photographic paper support wherein the top and the bottom sheets, made of Ex. 3b of Table 2, consisting of material NC 3 with 7.5 weight % smectite clay, are laminated onto the same sheet of cellulosic paper as in Composite support 2a, utilizing the same top and bottom tie layers made of clear polyethylene as in Composite support 2a, as schematically shown herein below. The thickness of the top and the bottom sheets is the same as that of Composite support 2a, and is equal to 0.0191 mm, and the YM of the top and the bottom sheets is 3282 MPa. The thickness and YM of the middle sheet of cellulosic paper are the same as those of Composite support 2a, and are equal to 0.1524 mm and 5688 MPa, respectively. The thickness and YM of the top and the bottom tie-layers are the same as those of Composite support 2a, and are equal to 0.0127 mm and 138 NPa, respectively.

Top sheet made of Ex 3b, (7.5% smectite content).
YM=3282 MPa; Thickness=0.0191 mm
Top tie-layer made of polyethylene
YM=138 MPa; Thickness=0.0127 mm
Sheet of cellulosic paper,
YM=5688 MPa; Thickness=0.1524 mm
Bottom tie-layer made of polyethylene
YM=138 MPa; Thickness=0.0127 mm
Bottom sheet made of Ex 3b, (7.5% smectite content);
YM=3282 MPa; Thickness=0.0191 mm The bending stiffness of Composite support 2b (invention) is 216 millinewtons, the overall caliper is 0.2160 mm, and the BMR rating for the backside is 2 and, therefore, acceptably good.

Comparison of Composite supports 2a (comparative) and 2b (invention) clearly reveals that for the same caliper with the same cellulosic paper core and clear polyethylene tie layers, composite support comprising the nanocomposite material made in accordance with the present invention provides higher stiffness and better back mark retention.

Composite Support 2c (Invention)

This support is a composite photographic paper support wherein the top and the bottom sheets, made of Ex. 3b of Table 2, consisting of material NC 3 with 7.5 weight % smectite clay, are laminated onto the same sheet of cellulosic paper as in Composite support 2a, utilizing the same top and bottom tie layers made of clear polyethylene as in Composite support 2a, as schematically shown herein below. The thickness of the top and the bottom sheets is the same and is equal to 0.0145 mm, and the YM of the top and the bottom sheets is 3282 MPa. The thickness and YM of the middle sheet of cellulosic paper are the same as those of Composite support 2a, and are equal to 0.1524 mm and 5688 MPa, respectively. The thickness and YM of the top and the bottom tie-layers are the same as those of Composite support 2a, and are equal to 0.0127 mm and 138 MPa, respectively.

Top sheet made of Ex 3b, (7.5% smectite content);
YM=3282 MPa; Thickness=0.0145 mm
Top tie-layer made of polyethylene
YM=138 MPa, Thickness=0.0127 mm
Sheet of cellulosic paper;
YM=5688 MPa; Thickness=0.1524 mm
Bottom tie-layer made of polyethylene
YM=138 MPa; Thickness=0.0127 mm
Bottom sheet made of Ex 3b, (7.5% smectite content),
YM=3282 MPa; Thickness=0.0145 mm The bending stiffness of Composite support 2c (invention) is 191 millinewtons, the overall caliper is 0.2068 mm, and the BMR rating for the backside is 2 and, therefore, acceptably good.

Comparison of Composite supports 2a (comparative) and 2c (invention) clearly reveals that for the same cellulosic paper core and the clear polyethylene tie layers, the composite support comprising the nanocomposite material made in accordance with the present invention can provide the same stiffness at overall lower caliper and better back mark retention. In fact, Composite support 2c (invention) provides the same stiffness at 24% reduced thickness of the top and bottom resin sheets, when compared with Composite support 2a (comparative), providing substantial savings in costly resin materials.

What is claimed is:

1. An imaging member comprising an image layer and a support comprising at least one extruded layer comprising an inorganic particle having an aspect ratio of at least 10 to 1, a lateral dimension of between 0.01 $\mu$m and 5 $\mu$m, and a vertical dimension between 0.5 nm and 10 nm, and polymeric resin.

2. The imaging member of claim 1 wherein said at least one layer comprising inorganic particle comprises smectite clay and polymeric resin forming at least one sheet.

3. The imaging member of claim 1 wherein said one layer comprising an inorganic particle comprises smectite clay and polymeric resin in an extrusion coated layer.

4. The imaging member of claim 2 wherein said at least one sheet is adhered to at least one side of a paper sheet.

5. The imaging member of claim 2 wherein said at least one sheet is adhered to both sides of a paper sheet.

6. The imaging member of claim 1 wherein said at least one layer comprising an inorganic particle comprises smectite clay particles.

7. The imaging member of claim 6 wherein said smectite clay comprises organically modified smectite.

8. The imaging member of claim 6 wherein said smectite clay comprises between 2 and 15 parts by weight of said at least one layer comprising smectite clay and resin.

9. The imaging member of claim 6 wherein said smectite clay comprises between 5 and 10 parts by weight of said at least one layer comprising smectite clay and resin.

10. The imaging member of claim 6 wherein said smectite clay particles comprise montmorillonite.

11. The imaging member of claim 1 wherein said inorganic particles comprise hydrotalcite.

12. The imaging member of claim 1 wherein said inorganic particles comprise mica.

13. The imaging member of claim 1 wherein said at least one layer comprising inorganic particle and polymeric resin comprises at least one sheet.

14. The imaging member of claim 13 wherein said at least one sheet is adhered to at least one side of a paper sheet.

15. The imaging member of claim 1 wherein said at least one layer comprising inorganic particles and resin comprises a polyester resin.

16. The imaging member of claim 15 wherein said support comprises one layer.

17. The imaging member of claim 1 wherein said resin is selected from the group consisting of polyolefin, polyester, polyamide, polystyrene, and polyurethane.

18. The imaging member of claim 1 wherein said image layer comprises at least one layer containing photosensitive silver halide.

19. The imaging member of claim 1 wherein said image layer comprises at least one layer containing ink jet receiving material.

20. The imaging member of claim 1 wherein said image layer comprises at least one layer containing thermal dye receiving material.

21. The imaging member of claim 1 wherein said support is oriented.

22. An imaging member comprising an image layer and a support, wherein said support comprises at least one layer comprising an inorganic particle and polymeric resin, wherein said inorganic particle is at least one member selected from the group consisting of hydrotalcite and mica having an aspect ratio of at least 10 to 1, a lateral dimension of between 0.01 $\mu$m and 5 $\mu$m, and a vertical dimension between 0.5 nm and 10 nm.

23. The imaging member of claim 22 wherein said at least one layer comprising inorganic particles and polymeric resin comprises at least one sheet.

24. The imaging member of claim 22 wherein said one layer comprising inorganic particles and polymeric resin comprises an extrusion coated layer.

25. The imaging member of claim 23 wherein said at least one sheet is adhered to at least one side of a paper sheet.

26. The imaging member of claim 23 wherein said at least one sheet is adhered to both sides of a paper sheet.

27. The imaging member of claim 22 wherein said inorganic particles comprise organically modified inorganic particles.

28. The imaging member of claim 22 wherein said inorganic particles comprise between 2 and 15 parts by weight of said at least one layer comprising inorganic particles and resin.

29. The imaging member of claim 22 wherein said inorganic particles comprise between 5 and 10 parts by weight of said at least one layer comprising inorganic particles clay and resin.

30. The imaging member of claim 22 wherein said at least one layer comprising inorganic particles and resin comprises a polyester resin.

31. The imaging member of claim 30 wherein said support comprises one layer.

32. The imaging member of claim 22 wherein said resin is selected from the group consisting of polyolefin, polyester, polyamide, polystyrene, and polyurethane.

33. The imaging member of claim 22 wherein said image layer comprises at least one layer containing photosensitive silver halide.

34. The imaging member of claim 22 wherein said image layer comprises at least one layer containing inkjet receiving material.

35. The imaging member of claim 22 wherein said image layer comprises at least one layer containing thermal dye receiving material.

36. The imaging member of claim 22 wherein said at least one layer comprising an inorganic particle comprises smectite clay particles.

37. The imaging member of claim 36 wherein said smectite clay particles comprise montmorillonite.

38. The imaging member of claim 22 wherein said inorganic particles comprise hydrotalcite.

39. The imaging member of claim 22 wherein said inorganic particles comprise mica.

40. An imaging member comprising an image layer and a support comprising one layer comprising an inorganic particle having an aspect ratio of at least 10 to 1, a lateral dimension of between 0.01 $\mu$m and 5 $\mu$m, and a vertical dimension between 0.5 nm and 10 nm, and polyester resin, wherein said one layer comprising an inorganic particle comprises smectite clay and polyester resin in an extrusion coated layer.

41. The imaging member of claim 40 wherein said one layer comprising inorganic particle comprises smectite clay and polyester resin forming a sheet.

42. The imaging member of claim 41 wherein said sheet is adhered to at least one side of a paper sheet.

43. The imaging member of claim 41 wherein said sheet is adhered to both sides of a paper sheet.

44. The imaging member of claim 40 wherein said one layer comprising an inorganic particle comprises smectite clay particles.

45. The imaging member of claim 44 wherein said smectite clay comprises organically modified smectite.

46. The imaging member of claim 44 wherein said smectite clay comprises between 2 and 15 parts by weight of said one layer comprising smectite clay and polyester resin.

47. The imaging member of claim 44 wherein said smectite clay comprises between 5 and 10 parts by weight of said one layer comprising smectite clay and polyester resin.

48. The imaging member of claim 44 wherein said smectite clay particles comprise montmorillonite.

49. The imaging member of claim 40 wherein said image layer comprises at least one layer containing photosensitive silver halide.

50. The imaging member of claim 40 wherein said image layer comprises at least one layer containing ink jet receiving material.

51. The imaging member of claim 40 wherein said image layer comprises at least one layer containing thermal dye receiving material.

52. The imaging member of claim 40 wherein said inorganic particles comprise hydrotalcite.

53. The imaging member of claim 40 wherein said inorganic particles comprise mica.

* * * * *